United States Patent [19]

Gluckstern

[11] 4,429,229

[45] Jan. 31, 1984

[54] VARIABLE STRENGTH FOCUSING OF PERMANENT MAGNET QUADRUPOLES WHILE ELIMINATING X-Y COUPLING

[75] Inventor: Robert L. Gluckstern, Hyattsville, Md.

[73] Assignee: New England Nuclear Corporation, Boston, Mass.

[21] Appl. No.: 296,550

[22] Filed: Aug. 26, 1981

[51] Int. Cl.[3] ..... G21K 1/08; H01F 1/00; H01J 3/24

[52] U.S. Cl. ..... 250/396 ML; 335/212

[58] Field of Search ..... 250/311, 396 R, 396 ML; 335/210, 212; 313/433, 442, 431

[56] References Cited

U.S. PATENT DOCUMENTS 2,944,182 7/1960 Rigrod ..... 313/442 X
4,355,236 10/1982 Holsinger ..... 250/396 ML

FOREIGN PATENT DOCUMENTS 693474 9/1976 U.S.S.R. ..... 250/396 ML

OTHER PUBLICATIONS

Conference on Charged Particle Optics, Gluckstern & Holsinger, Sep. 8–12, 1980.

Annals of Physics: 3,1–48 (1958), Courant and Snyder, pp. 1–48.

1979 Linear Accelerator Conference, Focussing of High Current Beams in Continuously Rotated Quadrupole Systems, R. Gluckstern.

*Primary Examiner*—Alfred E. Smith
*Assistant Examiner*—Jack I. Berman
*Attorney, Agent, or Firm*—Sewall P. Bronstein; George W. Neuner

[57] ABSTRACT

A method for producing various configurations of permanent magnet quadrupoles so that there is no coupling in the two transverse directions when focusing a charged particle beam is provided. Each configuration comprises a plurality of rotatable quadrupole disks, and means for rotating the quadrupole disks with respect to each other in a predetermined relationship.

10 Claims, 4 Drawing Figures

VARIABLE STRENGTH FOCUSING OF PERMANENT MAGNET QUADRUPOLES WHILE ELIMINATING X-Y COUPLING

FIELD OF THE INVENTION

This invention relates to variable strength permanent magnet quadrupoles and their application of focusing a particle beam, and particularly to focusing a particle beam using such quadrupoles while eliminating x-y coupling effects.

BACKGROUND OF THE INVENTION

Multipole magnets and particularly quadrupole magnets have been found useful for a variety of applications including, for example, focusing charged particle beams. Conventionally, electromagnets have been used for such multipole configurations because of the limitations of the field strength of permanent multipole magnets and because the field strength of electric magnets could be easily varied by controlling the coil current whereas the field strength of permanent magnets is fixed.

Rare earth-cobalt (REC) materials have renewed interest in permanent magnet multipoles. Most of the work has been done with respect to quadrupole magnets. For the past several years there has been considerable effort in developing permanent magnet quadrupoles for replacing electromagnets, particularly in applications such as the drift tubes in proton linacs.

Recently a new design for permanent magnet quadrupoles was described. See, for instance, Halbach, "Strong Rare Earth Cobalt Quadrupoles", IEEE Trans, Nucl. Sci., (June 1979), Holsinger et al., "A New Generation of Samarium-Cobalt Quadrupole Magnets for Particle Beam Focusing Applications", *Proc. Fourth Int. Workshop REC Perm. Mag. and Appl.*, (1979) and Halbach, "Design of Permanent Multipole Magnets With Oriented Rare Earth Cobalt Material", *Nucl. Inst. Meth.*, 169, pp. 1-10 (1980), which are hereby incorporated by reference. The new design for REC quadrupoles allows construction of compact quadrupoles with magnet aperture fields of at least 1.2 tesla (T) with presently available materials. The development of high field permanent magnet quadrupoles opens up their use in a variety of beam line applications. However, to realize the advantages of permanent magnet quadrupoles in large aperture beam line magnets, two significant problems need to be solved: (1) the quadrupole focusing strength must be adjustable in most applications, and (2) the cost of the REC pieces must be controlled so that the total cost of the quadrupole assembly will be comparable to that of an electromagnet including the power supply.

Various approaches have been suggested to adjust the quadrupole strength of these permanent magnet quadrupoles by rotation of the quadrupoles, but these typically have the undesirable feature of coupling the motion in the two transverse directions. Thus, it remains desirable to obtain variable strength permanent magnet quadrupoles for beam line applications wherein the quadrupoles produce no coupling of the beam line motion in the two transverse directions.

SUMMARY OF THE INVENTION

This invention provides a method for producing various configurations of permanent magnet quadrupoles so that there is essentially no coupling in the two transverse directions, each configuration having several rotatable quadrupole disks, and means for rotating the quadrupole disks with respect to each other in a predetermined relationship. Each quadrupole disk comprises a plurality of segments of an oriented, anisotropic, permanent magnet material arranged in a ring so that there is a substantially continuous ring of permanent magnet material, each segment having a predetermined easy axis orientation within a plane perpendicular to the axis of said disk.

In one embodiment, this invention provides a variable strength doublet quadrupole comprising two quadrupoles, each quadrupole being formed from two quadrupole disks of length $l_Q$ as described above. The center line of the two interior quadrupole disks are separated from each other by a distance l. The inside disk of each quadrupole is rotated an angle $-\beta$ and the outside disk of each quadrupole is rotated an angle $\alpha$, with the second quadrupole being rotated 90° with respect to the first quadrupole. If $\alpha$, $\beta$ and l are selected so that $$\tan\phi = \frac{l_Q}{l + 2l_Q}\tan\chi \tag{1}$$

where $$\chi = \alpha + \beta \tag{2}$$

and $$\phi = \beta - \alpha \tag{3}$$

then coupling in the transverse directions will be essentially eliminated.

In another embodiment, this invention provides a variable strength quadrupole having five quadrupole disks, each disk as described above. The strength of such quadrupole can be varied by rotating the disks with respect to each other and coupling in the two transverse directions can be essentially eliminated by selecting the angles of rotation of the disks so that:

$$\frac{\sin 2\alpha_2}{\sin 2\alpha_1} \simeq -4 \tag{4}$$

$$\frac{\sin 2\alpha_3}{\sin 2\alpha_1} \simeq 6 \tag{5}$$

$$\alpha_5 = \alpha_1 \tag{6}$$

and $$\alpha_4 = \alpha_2 \tag{7}$$

where $\alpha$ is the angle of rotation of a disk and the subscript denotes the particular disk being rotated, the subscripts being assigned to the disks in sequence.

DETAILED DESCRIPTION OF THE INVENTION

Figure 1:
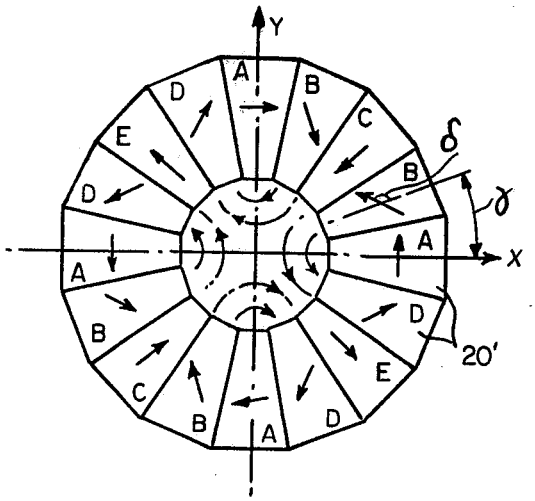
FIG. 1 illustrates a cross-section of a quadrupole disk consisting of 16 trapezoidal rare earth cobalt (REC) segments wherein the arrows indicate the easy axis orientation of each segment.

In accord with the present invention, with reference to the figures, an adjustable strength permanent multipole doublet 10 or singlet 50 comprises a plurality of quadrupole disks 12,52 each disk comprising a plurality of segments of REC material 20 arranged in a ring so that each segment has a predetermined easy axis orientation.

The arrows in each REC segment 20', 20'', indicate the direction of the easy axis throughout that segment. Particularly, with reference to FIGS. 1 and 2, the radial symmetry line of a segment forms an angle $\gamma$ with the x-axis and the direction of the easy axis forms an angle $\delta$ with the symmetry line.

For a segmented ring quadrupole with M trapezoidal pieces made of "perfect" REC material, the pole tip field is given by:

$$B_o = 2\mu_o H_c \cos^2\left(\frac{\pi}{M}\right) \frac{\sin\left(\frac{2\pi}{M}\right)}{\frac{2\pi}{M}}\left(1 - \frac{r_i}{r_o}\right) \quad \text{(I)}$$

where $\mu_o$ is the permeability of free space, $H_c$ is the coercive magnetic force of the material, $r_i$ is the inner radius of the ring and $r_o$ is the outer radius of the ring along the radial symmetry line of a segment.

For $M \rightarrow \infty$, i.e. a quadrupole with continuously varying easy axes, Equation (I) becomes:

$$B_o = 2\mu_o H_c\left(1 - \frac{r_i}{r_o}\right) \quad \text{(II)}$$

Two important theoretical parameters to consider for a segmented ring quadrupole are: (1) the decrease in the quadrupole strength due to the non-continuous easy axis orientation and (2) the order and magnitude of the harmonic multipole field errors introduced by the geometrical shape effects of the pieces. When $M=16$, Equation (I) gives the result that the pole tip field is reduced by only 6.3% compared to the continuous easy axis orientation.

The nth order harmonic multipole error fields which are excited in a symmetrical array of M identically shaped (not necessarily trapezoidal) and rotationally symmetric pieces are:

$$n=2+kM;\ k=1, 2, 3 \quad \text{(III)}$$

i.e., for $M=16$ the first multipole error is $n=18$, the 36-pole. The magnitude of the 36-pole error for the specific case of 16 trapezoidal pieces with $r_i/r_o=1.1/3.0$ is 6.8% of the quadrupole field at 100% aperture or 0.2% at 80% aperture. This error may be eliminated by a suitable thickness shim between the trapezoidal pieces in which the first theoretical error would be of order 34, the 68-pole.

Figure 2:
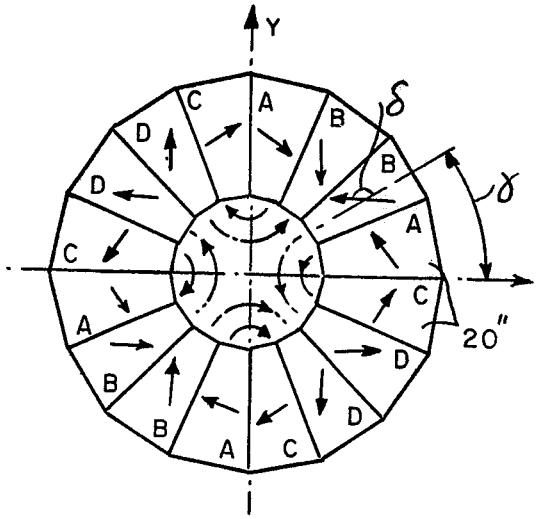
FIG. 2 illustrates a cross-section of another quadrupole disk consisting of 16 trapezoidal REC segments wherein the arrows indicate the easy axis orientation of each segment.

Although any anisotropic material can be used, rare earth cobalt and ceramic ferrite materials are preferred and samarium cobalt is particularly preferred. Quadrupoles in accord with this invention can be made, for example, from Hicorex 90B, a $SmCo_5$ compound which has nominal properties of $B=8.7$ Kilo-gauss, $H_c=8.2$ Kilo-oersteds, $H_{ci}=15$ Kilo-oersteds, where $H_{ci}$ is the intrinsic coercivity, and a recoil permeability of 1.05. The construction of quadrupole disks as illustrated in FIGS. 1 and 2 is described in copending application Ser. No. 143,449 filed Apr. 24, 1980 for "Variable Strength Beam Line Multipole Permanent Magnets and Methods For Their Use", which application is assigned to a common assignee with the present application and which is hereby incorporated by reference. Said application has issued as U.S. Pat. No. 4,335,236 on Oct. 19, 1982.

An important use for permanent magnet quadrupoles is for focusing beam lines because permanent magnets eliminate the power sources and cooling devices required to remove the heat generated by electromagnets. However, permanent magnet quadrupoles are not inherently adjustable in strength. One way for adjusting the strength of such quadrupole comprised of rotatable quadrupoles disks is described in copending application Ser. No. 143,449, supra. The method for making variable strength quadrupoles described in this copending application is suitable for applications where x-y coupling is not particularly troublesome.

Quadrupoles provide net focusing of a beam line by alternating the polarity of successive quadrupoles. Alternating polarity is equivalent to rotating a quadrupole 90° around its axis. Thus, it is common to use quadrupoles in doublets when the application is focusing beam lines. The second quadrupole in the doublet is rotated 90° with respect to the first quadrupole to achieve alternating polarity of the quadrupoles.

Figure 3:
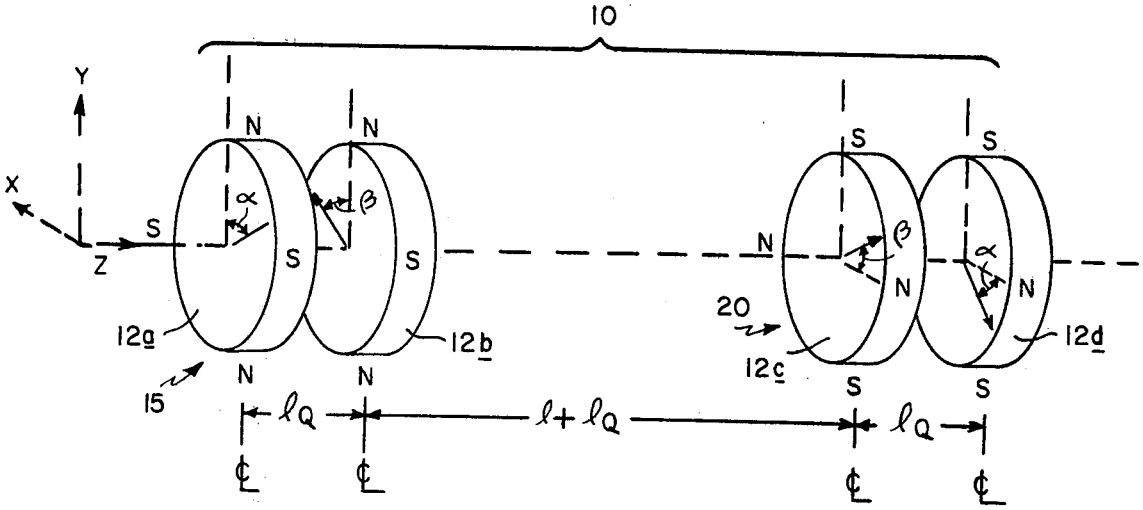
FIG. 3 illustrates an exploded view of a variable strength quadrupole doublet made from four quadrupole disks.

With reference to FIG. 3, I have discovered that the transverse direction coupling (i.e. x-y coupling) in variable strength permanent magnet quadrupoles can be virtually eliminated by using a quadrupole doublet wherein each quadrupole comprises two quadrupole disks.

A doublet in accord with one embodiment of my invention is illustrated in FIG. 3. The quadrupole doublet 10 is comprised of quadrupole 15 and quadrupole 20, each of which are themselves formed of two quadrupole disks such as those illustrated in FIGS. 1 and 2. The north pole (N-pole) of quadrupole 20 is rotated 90° with respect to the north pole of quadrupole 15.

In quadrupole 15, outer disk **12*a* is rotated an angle of degrees from the original alignment wherein the N-pole is aligned with the y-axis and inner disk 12*b* is rotated an angle $-\beta$ from the original alignment wherein the N-pole is aligned with the y-axis. In quadrupole 20, inner disk 12*c* is rotated an angle $-\beta$ from the original alignment wherein the N-pole is aligned with the -x-axis and outer disk 12*d* is rotated an angle $\alpha$ from the original alignment wherein the N-pole is aligned with the -x-axis. Thus, the two outer quadrupole disks in the doublet, 12*a* and 12*d*, are rotated in the same direction $\alpha$ degrees and the two inner quadrupole disks in the doublet, 12*b* and 12*d*** are rotated in the same direction (opposite from that of 12*a* and **12*d***) $-\beta$ degrees.

Coupling in the two transverse direction, i.e. x-y coupling, is essentially eliminated by rotating disks **12*a* and 12*d* $\alpha$ degrees and disks 12*b* and 12*c*** $-\beta$ degrees where $\alpha$ and $\beta$ are determined by Equations (1)-(3), above, or by the following criteria:

$$\frac{\sin 2\beta}{\sin 2\alpha} \simeq \frac{l + 3l_Q}{l + l_Q} \tag{8}$$

Such quadrupole doublets in accord with the invention can be used as building blocks for focusing beam lines. A triplet can be made by using two such doublets back-to-back.

Figure 4:
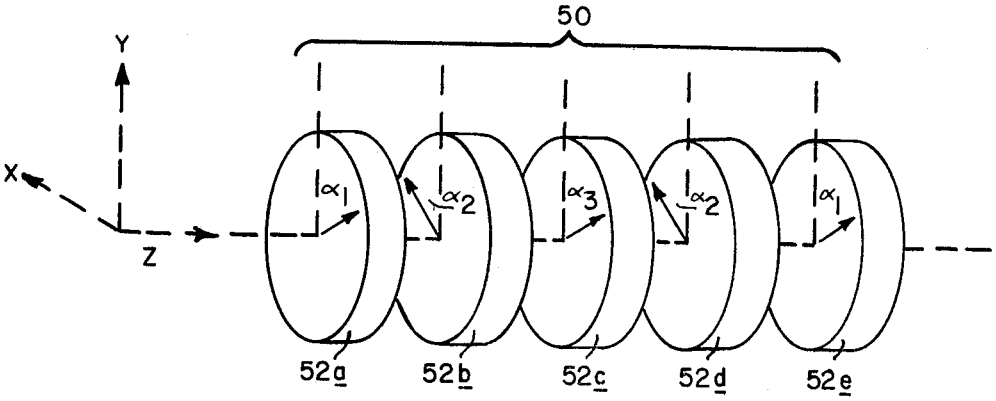
FIG. 4 illustrates an exploded view of a variable strength quadrupole having five quadrupole disks.

FIG. 4 illustrates another embodiment of the invention that provides a variable strength quadrupole or singlet which essentially eliminates x-y coupling. The quadrupole singlet 50 is comprised of five quadrupole disks 52*a*, 52*b*, 52*c*, 52*d* and 52*e*. Each quadrupole disk is rotated a predetermined angle to eliminate x-y coupling. Disks 52*a* and 52*e* are rotated $\alpha_1$ degrees. Disks 52*b* and 52*d* are rotated $-\alpha_2$ degrees. Disk 52*c* is rotated $\alpha_3$ degrees. Angles $\alpha_1$, $\alpha_2$ and $\alpha_3$ are determined by the following relationships when the angle $\theta$ is small:

$$\frac{\sin 2\alpha_2}{\sin 2\alpha_1} \simeq -4 \tag{9}$$

$$\frac{\sin 2\alpha_3}{\sin 2\alpha_1} \simeq 6 \tag{10}$$

Alternatively, when the $\alpha$'s are small, they can be calculated from:

$$\frac{\alpha_2}{\alpha_1} \simeq -4 \cosh\theta \cos\theta \tag{11}$$

$$\frac{\alpha_3}{\alpha_1} \simeq 2(1 + \cosh 2\theta + \cos 2\theta) \tag{12}$$

Here $\theta$ is given by $$\theta^2 = \frac{e|B'|l_Q^2}{mv}$$

where $|B'|$ is the magnetitude of the quadrupole gradient, e is the particle charge, m is the particle mass, v is the particle velocity, and $l_Q$ is as previously defined. In either case $\alpha_1$ is selected and $\alpha_2$ and $\alpha_3$ are calculated for each value of $\alpha_1$. The relative values of $\alpha_1$, $\alpha_2$ and $\alpha_3$ are preferably 1, $-4$ and 6, respectively in the limit of small $\alpha$ and $\theta$. Alternatively, the angles could be in the ratio 1, $-1$, 1, with the disk thicknesses being in the ratio 1, 4, 6.

The coupling in the two transverse directions can be exactly eliminated both for the doublet configuration and for the five disk configuration. For the doublet, Equation (1) gives the approximate relation between $\phi$ and $\chi$ for small disk thickness, neglecting fringing field effects along the axis. The exact elimination of x-y coupling for arbitrary disk thickness and allowing for fringing field effects can be accomplished as follows:

(1) Choose a value for $\chi$, and set the initial values of the angles $\alpha$ and $\beta$ to be $$\alpha_i = \beta_i = \frac{\chi}{2}$$

(2) Measure the impulse of the doublet on a beam of particles as described by the matrix which relates the incoming displacement and angle in the x-direction and the initial displacement and angle in the y-direction to the outgoing displacement and angle in the x direction and the outgoing displacement and the angle in the y-direction. This matrix will have the form:

$$M = \begin{pmatrix} a & b & e & o \\ c & d & o & -e \\ e & o & d & b \\ o & -e & c & a \end{pmatrix}$$

The definition of the matrix elements $M_{jk}$, with $$M = \begin{pmatrix} M_{11} & M_{12} & M_{13} & M_{14} \\ M_{21} & M_{22} & M_{23} & M_{24} \\ M_{31} & M_{32} & M_{33} & M_{34} \\ M_{41} & M_{42} & M_{43} & M_{44} \end{pmatrix}$$

is the ratio of the measured final vector component $u_j^{(f)}$ to the initial component $u_k^{(i)}$, with all other initial components $u_m^{(i)}$, $m \neq k$, being zero. Here the vector describing the beam displacement and angle has the components $u_1 = x$, $u_2 = x'$, $u_3 = y$, and $u_4 = y'$.

A detailed discussion of the form of $4 \times 4$ coupling matrix and its properties is given in Courant and Snyder, *Annals of Physics*, Vol. 3, No. 1, January 1958, Section 4(c), pp. 27–36, which is hereby incorporated by reference.

(3) Calculate $\phi$ from the equation:

$$\tan\phi = \frac{2e}{d - a}$$

(4) The correct values of $\alpha$ and $\beta$ which exactly eliminate x-y coupling are then $$\alpha = \frac{\chi - \phi}{2}, \beta = \frac{\chi + \phi}{2}$$

For the five disk singlet with $\alpha_1 = \alpha_5$, $\alpha_2 = \alpha_4$, the matrix will have the form:

$$M = \begin{pmatrix} a & b & g & h \\ c & a & i & j \\ j & h & d & e \\ i & g & f & d \end{pmatrix}$$

where $$i = \frac{(a + d)g - hf}{b}$$

$$j = \frac{(a - d)h + ge}{b}$$

The procedure for adjusting $\alpha_2$ and $\alpha_3$ to eliminate the x-y coupling terms, g, h, i, j as follows:

(1) Set $\alpha_1$ as desired, and choose starting values for $\alpha_2$ and $\alpha_3$ (2) Measure the impulse of the five disk singlet on a beam of particles as described by the matrix whose elements are "a" to "j".

(3) Vary $\alpha_2$ and $\alpha_3$ until the two parameters g, h vanish exactly. The two equations for i and j will then guarantee that i and j will also vanish.

The disks in the variable strength quadrupoles of this invention can be rotated by any suitable mechanical means. Preferably, disks are rotated by electronically controlled motors wherein the relationships between the various angles are accurately calculated and controlled. Such control systems are readily designed by those of normal skill in the art.

The invention has been described in detail with reference to the preferred embodiments thereof. However, it will be appreciated that those skilled in the art, upon reading this disclosure, may make modifications and improvements within the spirit and scope of the invention.

I claim:

1. A variable strength permanent magnet quadrupole doublet comprising two quadrupoles, spaced a distance l apart, each quadrupole comprising two disks, each disk consisting of a plurality of segments of an oriented, anisotropic permanent magnet material arranged in a ring so that there is a substantially continuous ring of permanent magnet material, each segment having a predetermined easy axis orientation within a plane perpendicular to the axis of said disk; one quadrupole being rotated 90° with respect to the other quadrupole; means for rotating the two inner disks of the two quadrupoles an angle $-\beta$; and means for rotating the two outer disks of the two quadrupoles an angle $\alpha$ wherein $\alpha$ and $\beta$ are determined at any particular position by the following relationships:

$$\tan \phi = \frac{l_Q}{l + 2l_Q} \tan \chi$$

$\chi = \alpha + \beta$, and
$\phi = \beta - \alpha$;
$l_Q$ = thickness of the disk
thereby varying the strength of the quadrupole doublet while eliminating coupling in the transverse directions.

2. A method for focusing a charged particle beam comprising passing said beam through a variable strength permanent magnet quadrupole doublet as described in claim 1.

3. A variable strength permanent magnet quadrupole doublet comprising two quadrupoles spaced a distance l apart, each quadrupole comprising two disks, each disk consisting of a plurality of segments of an oriented, anisotropic permanent magnet material arranged in a ring so that there is a substantially continuous ring of permanent magnet material, each segment having a predetermined easy axis orientation within a plane perpendicular to the axis of said disk; one quadrupole being rotated 90° with respect to the other quadrupole; means for rotating the two inner disks of the two quadrupoles an angle $-\beta$; and means for rotating the two outer disks of the two quadrupoles an angle $\alpha$; wherein $\beta$ and $\alpha$ are determined at any particular position by the following relationships:

$$\frac{\sin 2\beta}{\sin 2\alpha} \simeq \frac{l + 3l_Q}{l + l_Q}$$

where $l_Q$ is the thickness of each disk, thereby varying the strength of the quadrupole doublet while eliminating x-y coupling.

4. A method for focusing a charged particle beam comprising passing said beam through a variable strength permanent magnet quadrupole doublet as described in claim 3.

5. A variable strength permanent magnet quadrupole comprising five disks, each disk comprising a plurality of segments of an oriented, anisotropic permanent magnet material arranged in a ring so that there is a substantially continuous ring of permanent magnet material, each segment having a predetermined easy axis orientation within a plane perpendicular to the axis of said disk; and means to rotate the disks relative to each other so that the two outer disks are rotated $\alpha_1$ degrees, the center disk is rotated $\alpha_3$ degrees, and the remaining two disks are rotated $-\alpha_2$ degrees, wherein $\alpha_1$, $\alpha_2$ and $\alpha_3$ are determined at any particular position by the following relationships:

$$\frac{\sin 2\alpha_2}{\sin 2\alpha_1} \simeq -4, \text{ and}$$

$$\frac{\sin 2\alpha_3}{\sin 2\alpha_1} \simeq 6;$$

thereby varying the strength of the quadrupole while eliminating x-y coupling.

6. A method for focusing a charged particle beam comprising passing said beam through a variable strength permanent magnet quadrupole as described in claim 5.

7. A variable strength permanent magnet quadrupole comprising five disks, each disk comprising a plurality of segments of an oriented, anisotropic permanent magnet material arranged in a ring so that there is a substantially continuous ring of permanent magnet material, each segment having a predetermined easy axis orientation within a plane perpendicular to the axis of said disk; and means to rotate the disks relative to each other so that the two outer disks are rotated $\alpha_1$ degrees, the center disk is rotated $\alpha_3$ degrees, and the remaining two disks are rotated $-\alpha_2$ degrees, wherein $\alpha_1$, $\alpha_2$ and $\alpha_3$ are determined at any particular position by the following relationships:

$$\frac{\alpha_2}{\alpha_1} = -4 \cosh \theta \cos \theta,$$

$$\frac{\alpha_3}{\alpha_1} = 2\,(1 + \cosh 2\theta + \cos 2\theta), \text{ and}$$

$$\theta^2 = \frac{e|B'|l_Q^2}{mv};$$

where
e = particle charge;
$|B'|$ = magnetitude of the quadrupole gradient;
$l_Q$ = length of quadrupole disk;
m = mass of particle; and
v = velocity of particle;
thereby varying the strength of the quadrupole while eliminating x-y coupling.

8. A method for focusing a charged particle beam comprising passing said beam through a variable strength permanent magnet quadrupole as described in claim 7.

9. A variable strength permanent magnet quadrupole comprising five disks, each disk comprising a plurality of segments of an oriented anisotropic permanent magnet material arranged in a ring so that there is a substantially continuous ring of permanent magnet material, each segment having a predetermined easy axis orientation within a plane perpendicular to the axis of said disk; and means to rotate the disks relative to each other so that the two outer disks are rotated $\alpha_1$ degrees, the center disk is rotated $\alpha_3$ degrees, and the remaining two disks are rotated $-\alpha_2$ degrees, wherein the relative values of $\alpha_1$, $\alpha_2$ and $\alpha_3$ at any particular position are 1, $-4$, and 6, respectively; thereby varying the strength of the quadrupole while eliminating x-y coupling.

10. A method for focusing a charged particle beam comprising passing said beam through a variable strength permanent magnet quadrupole as described in claim 9.

* * * * *